US009476437B2

(12) United States Patent
Egawa et al.

(10) Patent No.: US 9,476,437 B2
(45) Date of Patent: Oct. 25, 2016

(54) BOOM DRIVING DEVICE

(71) Applicant: KAYABA INDUSTRY CO., LTD., Tokyo (JP)

(72) Inventors: Masahiro Egawa, Kawaguchi (JP); Haruhiko Kawasaki, Atsugi (JP); Yasuhiro Yonehara, Zama (JP)

(73) Assignee: KYB Corporation, Tokyo (JP)

( * ) Notice: Subject to any disclaimer, the term of this patent is extended or adjusted under 35 U.S.C. 154(b) by 300 days.

(21) Appl. No.: 14/373,650

(22) PCT Filed: Mar. 18, 2013

(86) PCT No.: PCT/JP2013/057632

§ 371 (c)(1),
(2) Date: Jul. 22, 2014

(87) PCT Pub. No.: WO2013/146409

PCT Pub. Date: Oct. 3, 2013

(65) Prior Publication Data

US 2015/0007557 A1 Jan. 8, 2015

(30) Foreign Application Priority Data

Mar. 26, 2012 (JP) ..... 2012-070053

(51) Int. Cl.
*F15B 15/20* (2006.01)
*F15B 21/14* (2006.01)
*E02F 9/20* (2006.01)
(Continued)

(52) U.S. Cl.
CPC ..... *F15B 15/20* (2013.01); *E02F 9/2075* (2013.01); *E02F 9/2207* (2013.01); *E02F 9/2217* (2013.01); *E02F 9/2282* (2013.01); *E02F 9/2292* (2013.01); *E02F 9/2296* (2013.01); *F04B 7/02* (2013.01); *F15B 21/14* (2013.01);
(Continued)

(58) Field of Classification Search
CPC ..... E02F 9/2075; E02F 9/2207; F04B 7/02; F15B 21/14
USPC ..... 91/436
See application file for complete search history.

(56) References Cited

U.S. PATENT DOCUMENTS

| | | | | |
|---|---|---|---|---|
| 9,102,052 | B2 * | 8/2015 | Lawson | B25J 3/04 |
| 2003/0047898 | A1 * | 3/2003 | Nagy | B60G 21/0555 280/124.157 |
| 2009/0077837 | A1 | 3/2009 | Tozawa et al. | |
| 2011/0017310 | A1 | 1/2011 | Eriksson | |
| 2012/0304630 | A1 | 12/2012 | Kawasaki et al. | |

FOREIGN PATENT DOCUMENTS

| | | |
|---|---|---|
| CN | 102094434 A | 6/2011 |
| CN | 102182730 A | 9/2011 |

(Continued)

*Primary Examiner* — Logan Kraft
(74) *Attorney, Agent, or Firm* — Rabin & Berdo, P.C.

(57) ABSTRACT

A boom driving device comprises a boom control valve causing a boom cylinder to elongate and contract. The boom control valve returns a hydraulic fluid discharged from an working chamber of the boom cylinder to a tank in a boom descending position A part of the discharged hydraulic fluid is branched in the upstream of the boom control valve and is supplied to a generator through a regenerative passage for power generation. The regenerative passage is provided with a regenerative control spool valve. The regenerative control spool valve is opened when a flow cross-sectional area of the hydraulic fluid flowing from the working chamber to the tank reaches a predetermined area while the boom control valve is in the descending position. According to this construction, it is possible to alleviate a shock that may be generated at the start of power generation by the generator.

4 Claims, 4 Drawing Sheets

(51) Int. Cl.
*E02F 9/22* (2006.01)
*F04B 7/02* (2006.01)

(52) U.S. Cl.
CPC ..... *F15B 2211/3058* (2013.01); *F15B 2211/30565* (2013.01); *F15B 2211/31558* (2013.01); *F15B 2211/634* (2013.01); *F15B 2211/665* (2013.01); *F15B 2211/7053* (2013.01); *F15B 2211/8606* (2013.01); *F15B 2211/88* (2013.01)

(56) References Cited

FOREIGN PATENT DOCUMENTS

| | | | |
|---|---|---|---|
| JP | 2006-336306 | A | 12/2006 |
| JP | 2010-084888 | A | 4/2010 |
| JP | 2011-127727 | A | 6/2011 |
| JP | 2011-179541 | A | 9/2011 |

* cited by examiner

BOOM DRIVING DEVICE

TECHNICAL FIELD

This invention relates to control of a boom driving device that performs regenerative power generation using a fluid returning from a boom cylinder used to rotate the boom upward and downward.

BACKGROUND ART

In general, a boom type construction machine comprises a boom cylinder that rotates a boom upward and downward. JP 2011-179541A published by the Japan Patent Office proposes a regenerative generator driven by a rotational torque of a hydraulic motor that rotates by a fluid returning from the boom cylinder when the boom is descended.

The boom cylinder comprises a rod-side chamber delimited by a piston on one side thereof in a cylinder and a piston-side chamber delimited by the piston on another side thereof in the cylinder. A hydraulic fluid is selectively supplied to one of the rod-side chamber and the piston-side chamber via a change-over valve that switches depending on an operating direction of the boom cylinder. The change-over valve also connects one of the rod-side chamber and the piston-side chamber to a tank.

This regenerative generator comprises a piston-side chamber that discharges the hydraulic fluid in response to contraction of the boom cylinder. A regenerative control spool valve is disposed in a passage connecting the piston-side chamber and the change-over valve. A part of the returning fluid is supplied to the hydraulic motor via the regenerative control spool valve for regenerative power generation.

The regenerative control spool valve has an operative position for cutting off connection between the piston-side chamber and the regenerative hydraulic motor and an operative position for supplying a part of the returning fluid to the regenerative hydraulic motor. In addition, the regenerative control spool valve controls a regenerative flow rate depending on a displacement position of a spool in the course of the position switching by continuously changing a flow cross-sectional area of the regenerative passage between the regenerative control spool valve and the regenerative hydraulic motor.

According to the aforementioned configuration, a part of the returning fluid discharged from the piston-side chamber of the boom cylinder is supplied to the hydraulic motor via a regenerative spool valve, and the remaining fluid returns to the tank via the change-over valve.

In other words, a sum of the regenerative flow rate and the recirculation flow rate corresponds to a total flow rate of the returning fluid from the boom cylinder. A contraction speed of the boom cylinder is determined based on a total flow rate of the returning fluid. The total amount of the returning fluid is determined based on a control position of the change-over valve.

SUMMARY OF INVENTION

In order to allow the regenerative hydraulic motor connected to the regenerative passage to start to rotate from a stationary state, a predetermined start torque is necessary. In other words, the hydraulic motor does not start immediately to rotate when the regenerative flow is supplied to the regenerative hydraulic motor.

Accordingly, a delay is slightly generated until the hydraulic motor actually starts to rotate after the regenerative control spool valve is operated to start to supply the fluid to the regenerative passage. This delay generates a temporary change in the flow rate of the regenerative passage. As a result, a total amount of the returning fluid discharged from the piston-side chamber of the boom cylinder experiences an instantaneous change and a shock may thereby be generated.

A change in the flow rate of the returning fluid generated when starting the hydraulic motor may affect the descending speed of the boom. This change may make an operator feel a discomfort.

The discomfort of the operator becomes significant, particularly, when the descending speed of the boom is controlled within a narrow range.

This is because when the boom control valve is controlled while a returning flow rate is low, a ratio of the flow rate changed by starting the hydraulic motor with respect to a total returning flow rate increases. On the contrary, when the descending speed of the boom is high, a returning flow rate discharged from the piston-side chamber is naturally high, and a ratio of the flow rate changed by starting the hydraulic motor is relatively insignificant. In such a situation, it is unlikely that the operator feels a discomfort.

It is therefore an object of this invention to alleviate a discomfort of the operator when the returning fluid from the boom cylinder is used as regenerative energy.

In order to achieve the above object, this invention provides a boom driving device, comprising a boom cylinder that elongates to rotate a boom upward in response to a supply of working fluid to a working chamber and contracts to rotate the boom downward in response to discharge of the working fluid from the working chamber, a boom change-over valve that displaces between a pump position connecting the working chamber to a pump and a tank position connecting the working chamber to a tank while increasing a connecting cross-sectional area between the working chamber and the tank when displacing towards the tank position, a power generator, a regenerative passage that is branched off at a position upstream of the boom change-over valve from a passage connecting the working chamber to the tank and supplies a part of the working fluid discharged from the working chamber to drive the generator to rotate, and a regenerative control valve that opens and closes the regenerative passage.

The boom driving device further comprises a sensor that detects a displacement position of the boom control valve, and a programmable controller programmed to open the regenerative control valve when a displacement position of the boom control valve has exceeded a predetermined position in a course of displacement towards the tank position.

The details as well as other features and advantages of this invention are set forth in the remainder of the specification and are shown in the accompanying drawings.

DESCRIPTION OF EMBODIMENTS

Figure 1:
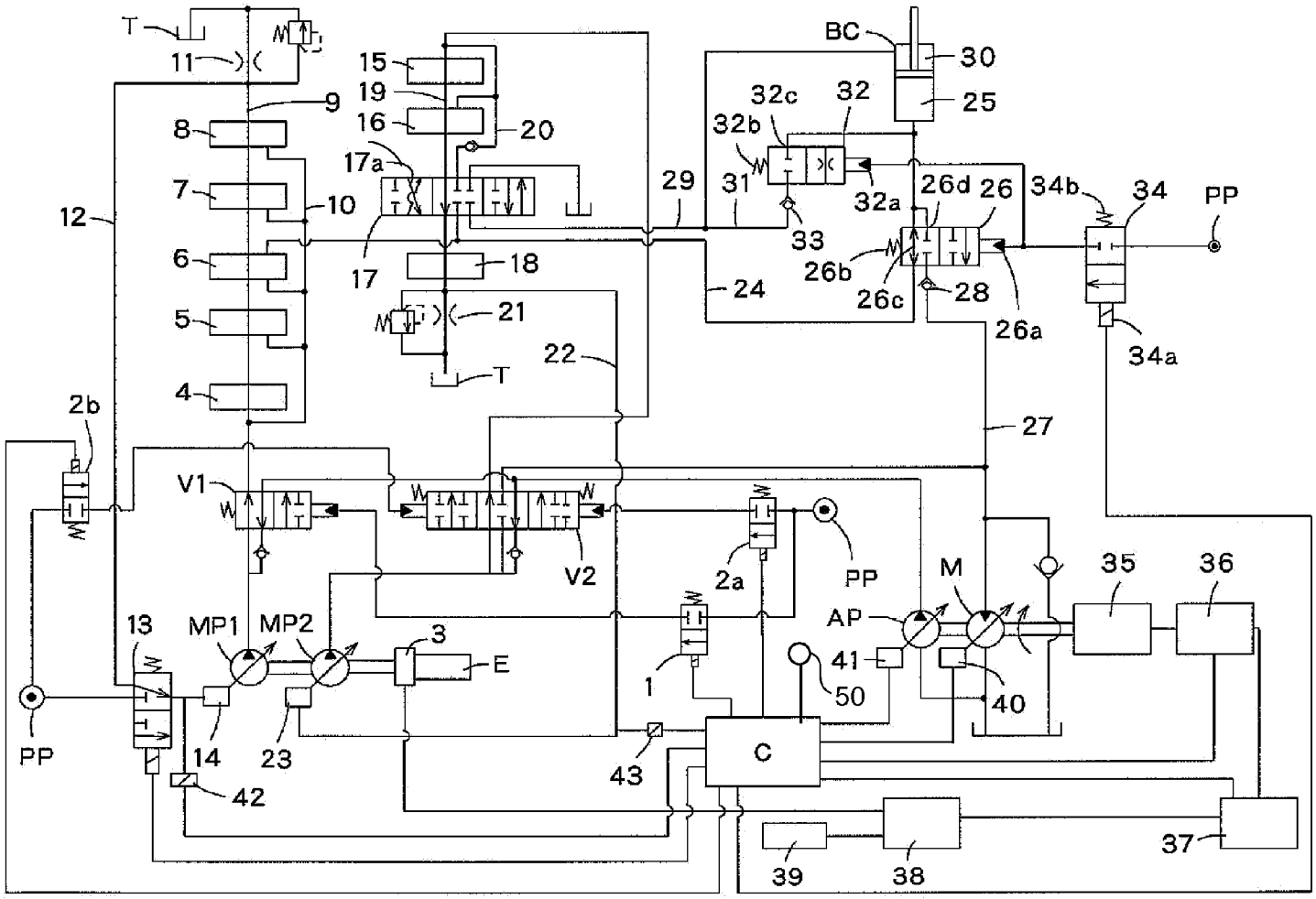
FIG. 1 is a hydraulic circuit diagram of a boom driving device according to a first embodiment of this invention.

Referring to FIG. 1 of the drawings, a boom driving device of a construction machine according to this invention comprises a first main pump MP1 of a variable capacity type, a second main pump MP2 of a variable capacity type, and an auxiliary pump AP of a variable capacity type. A discharge port of the first main pump MP1 is connected to a first circuit through a first change-over valve V1. A discharge port of the second main pump MP2 is connected to a second circuit through a second change-over valve V2. A discharge port of the auxiliary pump AP is combined with the discharge port of the first main pump MP1 through the first change-over valve V1. All of the first and second main pumps MP1 and MP2 and the auxiliary pump AP comprise a pump capable of pressurizing and supplying a hydraulic fluid.

In the following description, with regard to valves operated in response to energy supplied from the outside, such as an electromagnetic valve operated in response to magnetic excitation of a solenoid and a pilot valve operated in response to a pilot pressure, a valve operation position with no external energy supply will be referred to as an OFF-position, and a valve operation position with external energy supply will be referred to as an ON-position. When there is a plurality of the ON-positions, they may be referred to as a first ON-position, a second ON-position, and so on.

The first change-over valve V1 is a 4-port 2-position spool type change-over valve. In the first change-over valve V1, an end of the spool is provided with a pilot chamber, and another end of the spool is supported by a spring. The first change-over valve V1 is maintained in an OFF-position as illustrated in the figure by virtue of a biasing force of the spring while the pilot pressure is not supplied to the pilot chamber.

The first change-over valve V1 in the OFF-position supplies a discharged fluid of the first main pump MP1 to the first circuit and causes a fluid discharged from the variable capacity type auxiliary pump AP to adjoin the discharge port of the first main pump MP1 through a check valve.

As the first change-over valve V1 is switched to the ON-position located on the right side of the OFF-position in the figure by virtue of a pilot pressure in the pilot chamber, connection of a discharge port of the auxiliary pump AP to the discharge port of the first main pump MP1 is blocked while the fluid discharged from the first main pump MP1 is still supplied to the first circuit.

The second change-over valve V2 is a 6-port 3-position spool type change-over valve. In the second change-over valve V2, pilot chambers are provided on both sides of the spool, and the spool is supported by a centering spring. The second change-over valve V2 is typically maintained in an OFF-position as illustrated in the figure by virtue of an elastic force of the centering spring.

In the OFF-position, the second change-over valve V2 supplies a discharged fluid of the second main pump MP2 to the second circuit, and causes the discharged fluid of the auxiliary pump AP to adjoin the discharge port of the second main pump MP2.

As the second change-over valve V2 is switched to a first ON-position located on the right side of the OFF-position in the figure by virtue of a pilot pressure of a pilot chamber on the right side, a flow of the discharged fluid from the auxiliary pump AP to the discharge port of the second main pump MP2 is disconnected while the discharged fluid of the second main pump MP2 is still supplied to the second circuit.

As the second change-over valve V2 is switched to a second ON-position on the left side of the OFF-position in the figure by virtue of a pilot pressure of another pilot chamber on the left side, both a flow of the discharged fluid of the auxiliary pump AP to the discharge port of the second main pump MP2 and a flow of the discharged fluid of the second main pump MP2 to the second circuit are disconnected. In the second ON-position, the discharged fluid from the second main pump MP2 is supplied to a hydraulic motor M that drives the auxiliary pump AP. In addition, in the OFF-position and the first ON-position, a flow of the discharged fluid from the second main pump MP2 to the hydraulic motor M is disconnected.

The pilot chamber of the first change-over valve V1 receives a pilot pressure from the pilot pressure source PP through an electromagnetic valve 1. In the OFF-position illustrated in the figure, the electromagnetic valve 1 is switched to an ON-position in which the pilot chamber is disconnected from the pilot pressure source PP by not exciting the solenoid. The discharged fluid of the pilot pressure source PP is supplied to the pilot chamber by exciting the solenoid.

One of the pilot chambers of the second change-over valve V2 is connected to the pilot pressure source PP through an electromagnetic valve 2*a*. The other pilot chamber of the second change-over valve V2 is connected to the pilot pressure source PP through an electromagnetic valve 2*b*. In the OFF-position illustrated in the figure, both electromagnetic valves 2*a* and 2*b*, in which the solenoid is not excited, disconnect the pilot chamber from the pilot pressure source PP. The discharged fluid of the pilot pressure source PP is supplied to the pilot chamber by exciting the solenoid.

The solenoids of the electromagnetic valves 1, 2*a*, and 2*b* are connected to a controller C.

The controller C is constituted by a microcomputer comprising a central processing unit (CPU), a read-only memory (ROM), a random access memory (RAM), and an input/output interface (I/O interface). The controller C may also constituted by a plurality of microcomputers.

The controller C excites or does not excite the solenoids of the electromagnetic valves 1, 2*a*, and 2*b* in response to input signals from an operator of the construction machine.

The first and second main pumps MP1 and MP2 are driven to rotate by an engine E comprising a rotational speed sensor not shown in the figure. The engine E is provided with a generator 3 that generates electric power using a surplus torque.

The first circuit connected to the first main pump MP1 is provided with a change-over valve 4 for controlling a swivel motor, a change-over valve 5 for controlling an arm cylinder, a boom 2-speed change-over valve 6 for controlling a boom cylinder BC, a change-over valve 7 for controlling a preliminary attachment, and a change-over valve 8 for controlling a left travel motor, according to an order from the upstream side.

The change-over valves 4 to 8 are connected to the first main pump MP1 through a neutral passage 9, a parallel passage 10, and the first change-over valve V1.

A pilot pressure control orifice 11 for generating a pilot pressure is provided in the downstream of the left travel motor change-over valve 8 provided in the neutral passage 9. The orifice 11 generates a high pilot pressure in the upstream side when the flow rate is high. The orifice 11 generates a low pilot pressure in the upstream side when the flow rate is low. In other words, the orifice 11 generates the pilot pressure depending on a control position of the change-over valves 4 to 8 located in the upstream side.

A pilot passage 12 is connected to the neutral passage 9 between the orifice 11 and the change-over valve 8. The pilot passage 12 is connected to a regulator 14 via an electromagnetic change-over valve 13. The regulator 14 controls a tilt angle of the first main pump MP1.

The electromagnetic change-over valve 13 is a valve for supplying a pilot pressure to the regulator 14. The electromagnetic change-over valve 13 selects one of the pilot passage 12 and the pilot pressure source PP as a source of the pilot pressure depending on a position thereof and connects the selected one to the regulator 14. In an OFF-position illustrated in the figure, the pressure of the pilot passage 12 is supplied to the regulator 14 as a pilot pressure. As an excitation current is supplied, the electromagnetic change-over valve 13 is switched to an ON-position to supply the pressure of the pilot pressure source PP to the regulator 14 as a pilot pressure.

The solenoid of the electromagnetic change-over valve 13 is connected to the controller C. As the operator of the construction machine inputs a signal, the controller C performs control such that the excitation current is supplied to the electromagnetic change-over valve 13 to switch the electromagnetic change-over valve 13 to the ON-position. Meanwhile, unless no signal is input from an operator, the controller C performs control such that the solenoid is not excited, and the electromagnetic change-over valve 13 is maintained in the OFF-position.

The regulator 14 controls the tilt angle of the first main pump MP1 in inversely proportional to the pilot pressure of the pilot passage 12 to set a discharge amount of the hydraulic fluid per rotation of the first main pump MP1.

When all of the change-over valves 4 to 8 are maintained in the OFF-position, that is, when the swivel motor, the arm cylinder, the boom cylinder BC, the preliminary attachment, and the left travel motor are not operated, the electromagnetic change-over valve 13 reduces the discharge amount of the first main pump MP1, compared to other cases. Such a condition may be satisfied, for example, when a warm-up operation is performed. It is preferable to reduce an energy loss during the warm-up operation.

The second circuit connected to the second main pump MP2 is provided with, sequentially from the upstream side, a change-over valve 15 for controlling a right travel motor, a change-over valve 16 for controlling a bucket cylinder, a boom control valve 17 for controlling a boom cylinder BC, and an arm 2-speed change-over valve 18 for controlling an arm cylinder.

The change-over valves 15 to 18 are connected to the second main pump MP2 through a neutral passage 19 and the second change-over valve V2. The change-over valve 16 and the boom control valve 17 are connected to the second main pump MP2 also through the parallel passage 20 and the second change-over valve V2.

A pilot pressure control orifice 21 is provided in the downstream side of the change-over valve 18 of the neutral passage 19. The orifice 21 supplies a pressure of the upstream side to a regulator 23 of the second main pump MP2 through a pilot passage 22 as a pilot pressure. The regulator 23 controls the tilt angle of the second main pump MP2 in inverse proportion to the pilot pressure to set the discharge amount of the hydraulic fluid per rotation of the second main pump MP2.

The boom control valve 17 is a 6-port 3-position spool type change-over valve. The input ports of the boom control valve 17 comprise a port connected to the neutral passage 19, a port connected to the parallel passage 20, and a port connected to a tank. In addition, the output ports of the boom control valve 17 comprise a pair of actuator ports and a port connected to the downstream side of the neutral passage 19. One of the actuator ports is connected to a piston-side chamber 25 of the boom cylinder BC through a passage 24. The other actuator port is connected to a rod-side chamber 30 of the boom cylinder BC through a passage 29.

The boom control valve 17 is maintained in one of three positions including a neutral position, a descending position, and an ascending position. The position of the boom control valve 17 is selected based on a control from the operator of the construction machine.

In the neutral position, the boom control valve 17 supplies the fluid discharged from the second main pump MP2 to the downstream side of the neutral passage 19 and disconnects the pair of the actuator ports. In this state, both the rod-side chamber 30 and the piston-side chamber 25 of the boom cylinder BC are tightly closed so that the boom is maintained in a current angle position.

In the descending position on the left side of the neutral position in the figure, the boom control valve 17 supplies the fluid discharged to the neutral passage 19 from the second main pump MP2 to the rod-side chamber 30 and returns the hydraulic fluid of the piston-side chamber 25 to the tank through the bleed path 17*a*. As a result, the boom cylinder BC descends the boom.

In the ascending position on the right side of the neutral position in the figure, the boom control valve 17 supplies the fluid discharged to the neutral passage 19 from the second main pump MP2 to the piston-side chamber 25 and returns the fluid discharged from the rod-side chamber 30 to the tank. As a result, the boom cylinder BC raises the boom.

The passage 24 connecting one of the actuator ports of the boom control valve 17 and the piston-side chamber 25 is provided with a regenerative control spool valve 26. The regenerative control spool valve 26 has a pilot chamber 26*a* facing an end of a spool and a spring 26*b* elastically supporting another end of the spool.

The regenerative control spool valve 26 maintains an OFF-position illustrated in the figure by virtue of an elastic force of the spring 26*b* when the pilot pressure is not supplied to the pilot chamber 26*a*. When the pilot pressure is supplied to the pilot chamber 26*a*, the regenerative control spool valve 26 is switched to an ON-position located on the right side of the OFF-position in the figure.

The regenerative control spool valve 26 has a bleed path 26*c* that connects the upstream side and the downstream side of the passages 24 and a path 26*d* that connects the piston-side chamber 25 of the boom cylinder BC to the hydraulic motor M through a regenerative passage 27.

In the OFF-position illustrated in the figure, the regenerative control spool valve 26 opens the bleed path 26*c* to connect the piston-side chamber 25 and one of the actuator ports of the boom control valve 17 and closes the path 26*d* to disconnect the piston-side chamber 25 and the regenerative passage 27.

In the ON-position on the right side of the OFF-position in the figure, the regenerative control spool valve 26 closes the bleed path 26*c* and opens the path 26*d*. As a result, the piston-side chamber 25 and one of the actuator ports of the boom control valve 17 are disconnected, and the piston-side chamber 25 and the regenerative passage 27 are connected.

The regenerative control spool valve 26 not only selects one of the pair of the positions alternatively but also maintains both the passage 24 and the regenerative passage 27 in a partial communication state and controls the opening areas thereof depending on the pilot pressure of the pilot chamber 26*a*.

The regenerative passage 27 is provided with a check valve 28 that allows a flow of the hydraulic fluid directed to the hydraulic motor M from the path 26*d* and blocks a reversal flow.

The passage 24 communicating with the piston-side chamber 25 of the boom cylinder BC and the passage 29 communicating with the rod-side chamber 30 of the boom cylinder BC are connected to each other through a recirculating passage 31 provided with a recirculating flow control valve 32. The recirculating flow control valve 32 is a spool valve including a pilot chamber 32*a* facing an end of a spool and a spring 32*b* elastically supporting another end of the spool.

The recirculating flow control valve 32 has a recirculating path 32*c* communicating with the recirculating passage 31. The recirculating flow control valve 32 serves as a variable orifice that closes the recirculating path 32*c* in an OFF-position and opens the recirculating path 32*c* depending on a pilot pressure in an ON-position, thereby controlling a flow rate of the recirculating passage 31.

The recirculating passage 31 is provided with a check valve 33 that allows a flow of the hydraulic fluid from the piston-side chamber 25 to the passage 29 and blocks a reversal flow.

The pilot pressure source PP is connected to the pilot chamber 26*a* of the regenerative control spool valve 26 and the pilot chamber 32*a* of the recirculating flow control valve 32 through a proportional electromagnetic valve 34. The proportional electromagnetic valve 34 comprises a solenoid 34*a* and a spring 34*b* that elastically supports a valve main body. The solenoid 34*a* is excited by an excitation current supplied from the controller C and drives the valve main body against the spring 34*b*.

The proportional electromagnetic valve 34 maintains an OFF-position illustrated in the figure by virtue of an elastic force of the spring 34*b* when the solenoid 34*a* is not excited. As the excitation current is supplied from the controller C to the solenoid 34*a*, the proportional electromagnetic valve 34 is switched to an ON-position to connect the pilot chambers 26*a* and 32*a* to the pilot pressure source PP at an opening area corresponding to the excitation current. In this manner, the pilot pressures in the pilot chambers 26*a* and 32*a* are controlled depending on the excitation current supplied from the controller C to the proportional electromagnetic valve 34.

However, the elastic force of the spring 32*b* of the recirculating flow control valve 32 is set to be higher than the elastic force of the spring 26*b* of the regenerative control spool valve 26. Under the same pilot pressure, a timing that the recirculating flow control valve 32 opens the recirculating path 32*c* is set to be delayed from a timing that the regenerative control spool valve 26 is set to the ON-position.

The hydraulic motor M connected to the regenerative control spool valve 26 is combined with a motor/generator 35 serving as an electric motor and a generator and rotating together with the auxiliary pump AP in synchronization about an identical axis. The motor/generator 35 is driven to rotate by the hydraulic motor M to serve as a generator. The electric power generated by the motor/generator 35 is charged in a battery 37 via an inverter 36. The battery 37 is connected to the controller C, and the controller C receives a signal indicating an electric charge amount of the battery 37.

The battery 37 is provided with a battery charger 38. The battery charger 38 charges the battery 37 using the electric power generated by the generator 3. A power source 39 of other systems, such as a general home use power source, may also be used to charge the battery charger 38.

The hydraulic motor M is a variable capacity type and comprises a regulator 40 for controlling a tilt angle. The regulator 40 changes the tilt angle of the hydraulic motor M in response to the signal from the controller C.

The auxiliary pump AP is also a variable capacity type and has a regulator 41 for controlling a tilt angle. The regulator 41 changes the tilt angle of the auxiliary pump AP in response to the signal from the controller C.

According to the configuration described above, when the hydraulic motor M drives the motor/generator 35 to rotate, it is possible to prevent a driving load of the auxiliary pump AP from being applied to the hydraulic motor M by minimizing the tilt angle of the auxiliary pump AP. When the motor/generator 35 serves as an electric motor, the auxiliary pump AP may operate as a pump by driving the auxiliary pump AP to rotate using a part of the output torque of the motor/generator 35.

In the boom driving device configured as described above, when the engine E is driven in a state where the electromagnetic valves 1, 2*a*, and 2*b* are not excited, and the first and second change-over valves V1 and V2 are maintained in the OFF-position as illustrated in the figures, the hydraulic fluid is supplied from the first and second main pumps MP1 and MP2 to the first and second circuits, respectively.

If the auxiliary pump AP operates simultaneously to discharge hydraulic fluid, the discharged fluid joins the discharged fluids of the first and second main pumps MP1 and MP2 and is supplied to the first and second circuits.

In order to operate the auxiliary pump AP, it is necessary to drive the motor/generator 35 as an electric motor using the electric power of the battery 37 and rotate the auxiliary pump AP using a rotational torque thereof. In this case, the hydraulic motor M preferably reduces a rotational resistance by minimizing the tilt angle to minimize a loss in the output power of the motor/generator 35 serving as an electrical motor. The auxiliary pump AP may also be operated using the rotational power of the hydraulic motor M.

The boom driving device further comprises a pressure sensor 42 that detects a pressure supplied to the regulator 14 of the first main pump MP1 and a pressure sensor 43 that detects a pressure supplied to the regulator 23 of the second main pump MP2. The detection data of the pressure sensors 42 and 43 are input to the controller C as signals.

The controller C controls the tilt angle of the auxiliary pump AP in response to the pressure signals input from the pressure sensors 42 and 43. A relationship between the input signals of the pressure sensors 42 and 43 and the tilt angle of the auxiliary pump AP is set in advance such that an assistant output power can be obtained most efficiently.

Meanwhile, as the first change-over valve V1 is switched to the ON-position on the right side of the OFF-position in the figure, only the fluid discharged from the first main pump MP1 is supplied to the first circuit. As the second change-over valve V2 is switched to the first ON-position on the right side of the OFF-position in the figure, only the fluid discharged from the second main pump MP2 is supplied to the second circuit.

As the second change-over valve V2 is switched to the second ON-position on the left side of the OFF-position in the figure, the fluid discharged from the second main pump MP2 is supplied to the hydraulic motor M. Therefore, if the controller C switches the second change-over valve V2 to the second ON-position using the electromagnetic valve 2*b* when the actuator connected to the second circuit is not actuated, the hydraulic motor M is driven to rotate such that the motor/generator 35 serves as a generator. The electric power generated by the motor/generator 35 is charged in the battery 37 via the inverter 36.

When the hydraulic motor M drives the motor/generator 35 to rotate, it is preferable that the tilt angle of the auxiliary pump AP be maintained at minimum in order to improve the electric power generation efficiency.

The controller C has a function of detecting an electric charge amount of the battery 37 and controlling a rotation speed of the hydraulic motor M depending on the electric charge amount.

Meanwhile, the hydraulic motor M may be driven to rotate using the returning fluid discharged from the piston-side chamber 25 when the boom cylinder BC operates to descend the boom.

When the boom cylinder BC contracts, the boom control valve 17 in the descending position controls the opening area of the bleed path 17*a* in response to a control amount directed by the operator. In other words, the opening area of the bleed path 17*a* of the boom control valve 17 is controlled such that the returning fluid returns from the piston-side chamber 25 of the contracting boom cylinder BC to the tank at a rate corresponding to a descending speed of the boom intended by the operator.

When the boom cylinder BC contracts, the controller C excites the solenoid 34*a* to switch the proportional electromagnetic valve 34 to the ON-position. As the proportional electromagnetic valve 34 opens, the pilot pressure from the pilot pressure source PP is introduced into the pilot chamber 26*a* of the regenerative control spool valve 26 and the pilot chamber 32*a* of the recirculating flow control valve 32.

However, as descried above, the elastic force of the spring 26*b* of the regenerative control spool valve 26 is smaller than the elastic force of the spring 32*b* of the recirculating flow control valve 32. Accordingly, the regenerative control spool valve 26 is first switched to the ON-position in response to the pilot pressure from the pilot pressure source PP. In this case, the switching level of the regenerative control spool valve 26 is proportional to the pilot pressure.

As the pilot pressure is introduced into the pilot chamber 26*a* of the regenerative control spool valve 26, the opening area of the bleed path 26*c* of the regenerative control spool valve 26 decreases, and the opening area of the path 26*d* increases. That is, while the passage 24 is narrowed, the flow rate of the returning fluid of the regenerative passage 27 to the hydraulic motor M increases.

The timing that the controller C switches the proportional electromagnetic valve 34 to open the path 26*d* of the regenerative control spool valve 26 is controlled based on a stroke of the spool of the boom control valve 17 as described below.

The controller C starts switching from the OFF-position to the ON-position of the regenerative control spool valve 26 after the stroke of the boom control valve 17 reaches a predetermined amount, and the bleed path 17*a* reaches a predetermined opening area.

In order to implement this control, the boom control valve 17 comprises a stroke sensor 50 that electrically detects a stroke position of the spool, so that the detected stroke position is input into the controller C as a signal.

The stroke sensor 50 may be a sensor capable of directly detecting a specific stroke position of the spool such as a limit switch or a sensor capable of indirectly detecting a stroke position on the basis of a duration of operation, a control position of a control lever, or the like.

Figure 2:
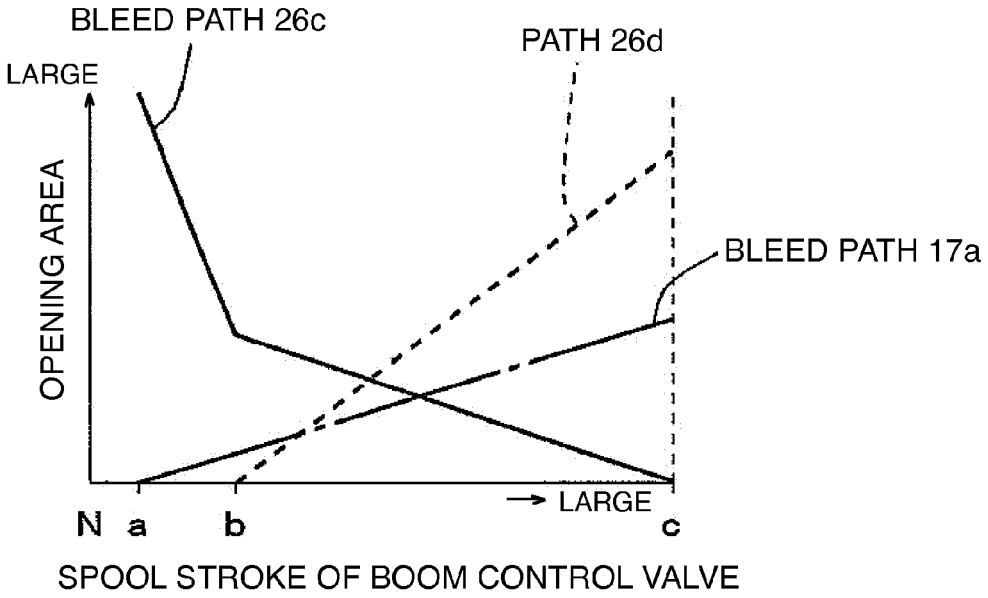
FIG. 2 is a diagram illustrating a switching timing of a regenerative control spool valve according to the first embodiment of this invention.

Referring to FIG. 2, the controller C performs control such that the opening area of the bleed path 26*c* of the regenerative control spool valve 26 decreases to a predetermined level, and the path 26*d* starts to be opened, when the boom control valve 17 is switched and manipulated by the operator from the point N corresponding to the neutral position, and the opening area of the bleed path 17*a* reaches a predetermined level corresponding to the point b as the stroke reaches the point b. In other words, the controller C controls the proportional electromagnetic valve 34 such that the path 26*d* of the regenerative control spool valve 26 starts to open as the stroke of the boom control valve 17 reaches the point b.

As a result, as the pilot pressure is introduced into the pilot chamber 26*a*, and the regenerative control spool valve 26 displaces toward the ON-position, the returning fluid from the piston-side chamber 25 of the boom cylinder BC is divided into a hydraulic fluid returning to the passage 24 via the bleed path 26*c* and a hydraulic fluid supplied to the hydraulic motor M via the path 26*d* depending on the displacement position of the regenerative control spool valve 26.

In FIG. 2, a section between the point N and the point b is a dead zone of the spool control of the regenerative control spool valve 26. The section after the point b is a controllable zone. Therefore, an inclination of the opening area against the stroke changes at the point b.

When the stroke of the spool is insignificant, and the opening area of the bleed path 17*a* of the boom control valve 17 is smaller than the opening area of the bleed path 26*c*, the opening area of the bleed path 17*a* dominantly affects the returning flow rate of the passage 24. When the stroke of the spool increases and the opening area of the bleed path 26*c* of the regenerative control spool valve 26 becomes smaller than the opening area of the bleed path 17*a*, the opening area of the bleed path 26*c* dominantly affects the returning flow rate of the passage 24.

The controller C controls the loads of the hydraulic motor M and the auxiliary pump AP by controlling the tilt angle of the hydraulic motor M and the auxiliary pump AP in order to maintain a desired descending speed of the boom.

When the regenerative control spool valve 26 operates, and the returning fluid is introduced into the regenerative passage 27 in order to start to rotate the hydraulic motor M in an inoperative state, a slight shock may be generated.

The controller C performs control such that the returning fluid is introduced into the regenerative passage 27 after a total amount of the returning fluid from the boom cylinder BC increases to a certain level. This determination can be performed by determining as to whether or not the opening area of the bleed path 17*a* has reached a predetermined area from the stroke position of the boom control valve 17. Therefore, it is possible to suppress an influence on a boom descending speed that a shock generated by starting the hydraulic motor M may exert. As a result, it is possible to alleviate a discomfort that the operator may feel when starting the hydraulic motor M.

When the boom descending speed intended by the operator is high, the stroke amount of the boom control valve 17 increases, and the opening area of the proportional electromagnetic valve 34 increases accordingly. As a result, the pilot pressure applied to the pilot chambers 26*a* and 32*a* also increases. As the pilot pressure increases, the recirculating flow control valve 32 is switched to the ON-position, so that the recirculating path 32*c* is opened.

As the recirculating path 32*c* is opened, a part of the returning fluid from the piston-side chamber 25 of the boom cylinder BC is supplied to the rod-side chamber 30 of the boom cylinder BC through the recirculating passage 31 and the passage 29.

When the descending speed of the boom cylinder BC is high, the returning fluid of the piston-side chamber 25 is supplied to the rod-side chamber 30 in order to prevent a negative pressure in the rod-side chamber 30 that may generate an abnormal noise.

The opening area of the recirculating path 32*c* and the timing that the recirculating flow control valve 32 is switched to the ON-position depend on the opening area of the proportional electromagnetic valve 34, the elastic force of the spring 32*b*, and the like. They are set in advance based on properties required to the boom cylinder BC.

It is possible to omit the recirculating passage 31 and the recirculating flow control valve 32 such that the returning fluid from the piston-side chamber 25 is distributed only to the passage 24 and the regenerative passage 27.

When the regenerative control spool valve 26 is in a full stroke state toward the ON-position, the bleed path 26*c* is blocked, and the passage 24 connected to the boom control valve 17 is disconnected from the piston-side chamber 25. However, the regenerative control spool valve 26 may be configured such that the passage 24 communicates with the piston-side chamber 25 with a minimum opening area when the regenerative control spool valve 26 is in the full stroke state toward the ON-position. Similarly, in this case, as the opening area of the passage 24 decreases, the opening area of the path 26*d* increases. Therefore, the flow rate of the returning fluid introduced into the regenerative passage 27 increases similarly.

However, if the passage 24 is perfectly blocked, the whole amount of the returning fluid is introduced into the regenerative passage 27. By perfectly blocking the passage 24, therefore, it is possible to fully use the energy generated by descending the boom to drive the hydraulic motor M without generating a loss.

The minimum opening area described above refers to the smallest opening area that the path 26*d* experiences in the course of the spool stroke of the regenerative control spool valve 26 between the OFF-position and the full stroke state.

Figure 3:
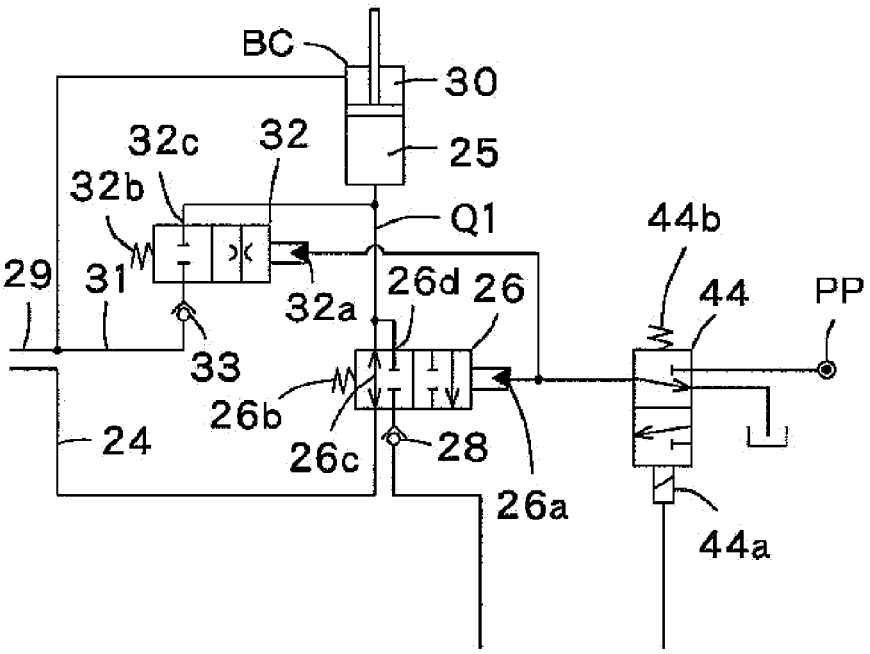
FIG. 3 is a hydraulic circuit diagram of a boom driving device according to a second embodiment of this invention.

Referring to FIG. 3, a second embodiment of this invention will be described.

This embodiment is different from the first embodiment in that a proportional electromagnetic pressure reducing valve 44 is provided instead of the proportional electromagnetic valve 34. The other components are identical to those of the first embodiment. With respect to the components that have the same construction as those of the first embodiment are given identical component numbers, and their description is herein omitted.

The proportional electromagnetic pressure reducing valve 44 comprises a solenoid 44*a* and a spring 44*b*. The spring 44*b* exerts an elastic force to bias the valve main body toward an OFF-position. The solenoid 44*a* drives the valve main body toward an ON-position against the spring 44*b* in response to the excitation current from the controller C.

Similar to the proportional electromagnetic valve 34, in the ON-position, the proportional electromagnetic pressure reducing valve 44 supplies the pilot pressure from the pilot pressure source PP to the pilot chamber 26*a* of the regenerative control spool valve 26 and the pilot chamber 32*a* of the recirculating flow control valve 32. Meanwhile, in the OFF-position, the pilot pressures of the pilot chambers 26*a* and 32*a* are released to the tank.

Similarly, in the boom driving device, the controller C detects that the bleed path 17*a* connecting the passage 24 and the tank has a predetermined opening area from the stroke position of the boom control valve 17. Then, the controller C switches the regenerative control spool valve 26 to guide the returning fluid from the piston-side chamber 25 to the regenerative passage 27 through the bleed path 26*c*.

Therefore, it is possible to suppress an influence on a boom descending speed that a shock generated by starting the hydraulic motor M may exert. As a result, it is possible to alleviate a discomfort that the operator may feel when starting the hydraulic motor M using the returning fluid of the regenerative passage 27.

Unlike the proportional electromagnetic valve 34 that controls connection or disconnection with the pilot pressure source PP, the proportional electromagnetic pressure reducing valve 44 can perform a wide range of control for the pilot pressure supplied to the pilot chambers 26*a* and 32*a* by switching between the pilot pressure source PP and the tank. It is therefore possible to perform proportional control for the regenerative control spool valve 26 across a wide range.

Figure 4:
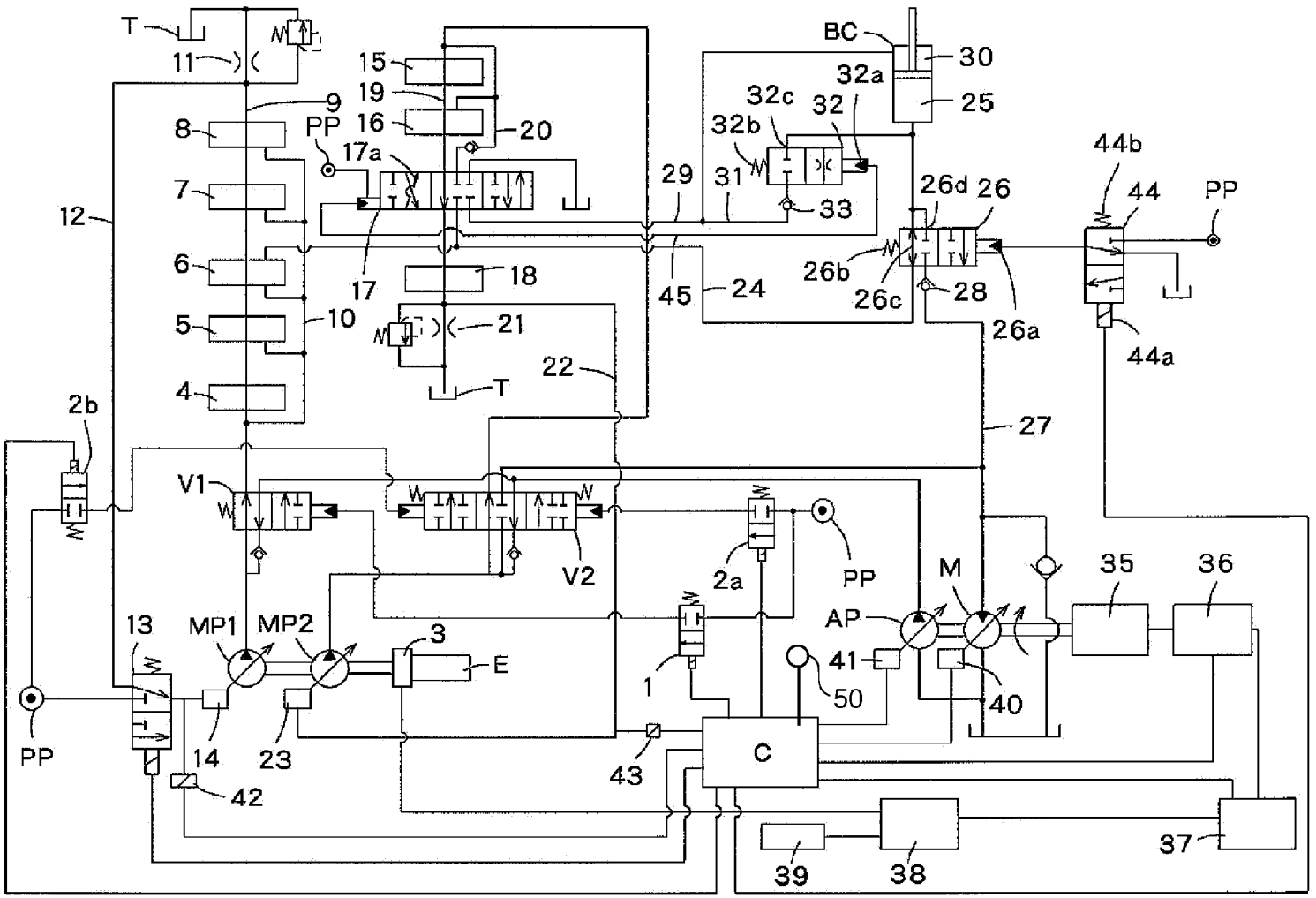
FIG. 4 is a hydraulic circuit diagram of a boom driving device according to a third embodiment of this invention.

Referring to FIG. 4, a third embodiment of the invention will be described.

According to this embodiment, the pilot pressure guided to the pilot chamber 32*a* of the recirculating flow control valve 32 is supplied, not from the pilot pressure source PP through the proportional electromagnetic pressure reducing valve 44, but from a change-over valve provided in the boom control valve 17.

Specifically, the change-over valve is switched as the boom control valve 17 is switched to the descending position, so that the pilot pressure of the pilot pressure source PP is supplied to the pilot chamber 32*a* of the recirculating flow control valve 32.

Since the other components are identical to those of the second embodiment, they are given identical component numbers, and their description is herein omitted.

In this boom driving device also, the controller C controls the timing that the returning fluid is guided to the regenerative passage 27 by controlling the regenerative control spool valve 26.

Specifically, the controller C detects that the opening area of the bleed path 17*a* serving as a passage for connecting the tank and the passage 24 connected to the piston-side chamber 25 has reached a predetermined area from the stroke position of the boom control valve 17. The controller C then controls the regenerative control spool valve 26 such that the returning fluid is introduced into the regenerative passage 27.

As a result, it is possible to suppress an influence on a boom descending speed that a shock generated by starting the hydraulic motor M may exert and alleviate a discomfort of the operator when the hydraulic motor M is actuated by the returning fluid of the boom cylinder BC.

According to this embodiment, the switching timing of the recirculating flow control valve 32 is determined on the basis of a control amount of the boom control valve 17. The controller C is not involved in the switching timing determination of the recirculating flow control valve 32. As a result, the switching of the recirculating flow control valve 32 is not synchronized with the switching of the regenerative control spool valve 26.

If the switching of the regenerative control spool valve 26 is synchronized with the switching of the recirculating flow control valve 32, it may be difficult to control a total flow rate of the returning fluid from the boom cylinder BC, that is, the descending speed of the boom cylinder BC.

According to this embodiment, since the control of the recirculating flow control valve 32 is not synchronized with the control of the regenerative control spool valve 26, it is possible to easily control a total flow rate of the returning fluid.

Figure 5:
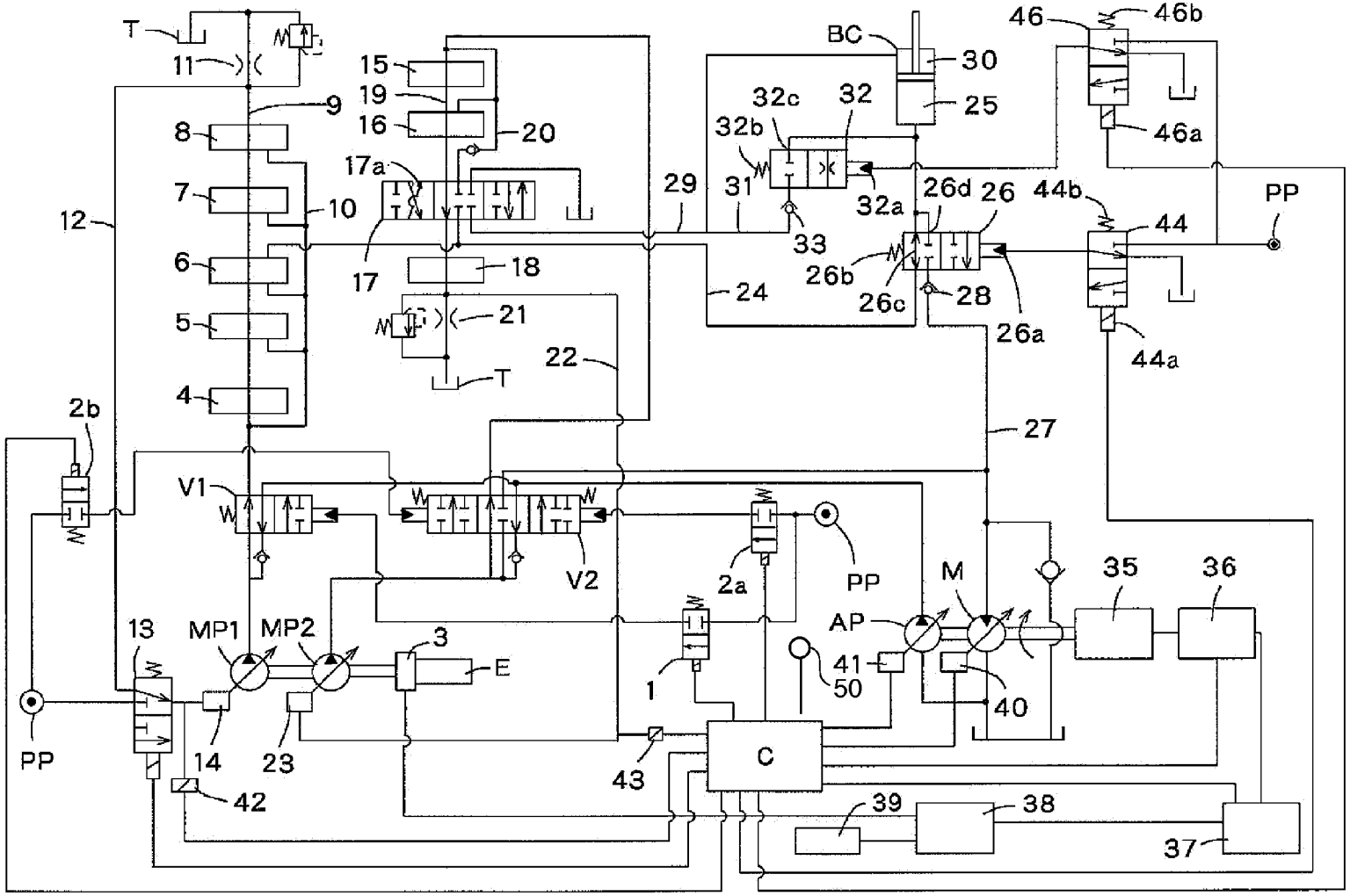
FIG. 5 is a hydraulic circuit diagram of a boom driving device according to a fourth embodiment of this invention.

Referring to FIG. 5, a fourth embodiment of this invention will now be described.

According to this embodiment, a proportional electromagnetic pressure reducing valve 46, which is different from the proportional electromagnetic pressure reducing valve 44, is provided between the pilot pressure source PP and the pilot chamber 32*a* of the recirculating flow control valve 32. Since the other components are identical to those of the second embodiment, they are given identical component numbers, and their description is herein omitted.

The proportional electromagnetic pressure reducing valve 46 comprises a spring 46*b* and a solenoid 46*a* connected to the controller C. While the solenoid 46*a* is not excited, the proportional electromagnetic pressure reducing valve 46 is maintained in an OFF-position by virtue of the spring 46*b*. In the OFF-position, the proportional electromagnetic pressure reducing valve 46 releases the pilot chamber 32*a* to the tank. As the solenoid 46*a* is excited, the proportional electromagnetic pressure reducing valve 46 is switched to an ON-position against the spring 46*b*. In the ON-position, the proportional electromagnetic pressure reducing valve 46 connects the pilot chamber 32*a* to the pilot pressure source PP.

According to this embodiment also, the controller C first detects from the stroke position of the boom control valve 17 that the opening area of the bleed path 17*a* serving as a passage connecting the piston-side chamber 25 and the tank via the passages 24 has reached a predetermined area. The controller C then controls the regenerative control spool valve 26 such that the returning fluid is introduced into the regenerative passage 27.

As a result, it is possible to suppress an influence on a boom descending speed that a shock generated by starting the hydraulic motor M may exert and alleviate a discomfort of the operator when the hydraulic motor M is actuated by the returning fluid of the boom cylinder BC.

According to this embodiment also, it is possible to individually control the pilot pressure of the recirculating flow control valve 32 and the pilot pressure of the regenerative control spool valve 26. For this reason, it is possible to control the regenerative control spool valve 26 without being influenced by the flow rate introduced into the regenerative passage 31. Therefore, it is possible to easily control the descending speed of the boom cylinder BC. In addition, it is possible to improve freedom in control of the recirculating flow control valve 32 and the regenerative control spool valve 26.

The contents of Tokugan 2012-70053, with a filing date of Mar. 26, 2012 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

INDUSTRIAL APPLICABILITY

This invention preferably applies to a boom driving device of a construction machine.

The embodiments of this invention in which an exclusive property or privilege is claimed are defined as follows:

The invention claimed is:

1. A boom driving device, comprising:

a boom cylinder that elongates to rotate a boom upward in response to a supply of working fluid to a working chamber and contracts to rotate the boom downward in response to discharge of the working fluid from the working chamber;

a boom change-over valve that displaces between a pump position connecting the working chamber to a pump and a tank position connecting the working chamber to a tank while increasing a connecting cross-sectional area between the working chamber and the tank when displacing towards the tank position;

a power generator;

a regenerative passage that is branched off at a position upstream of the boom change-over valve from a passage connecting the working chamber to the tank and supplies a part of the working fluid discharged from the working chamber to drive the generator to rotate;

a regenerative control valve that opens and closes the regenerative passage;

a sensor that detects a displacement position of the boom change-over valve;

a programmable controller programmed to:

open the regenerative control valve when a displacement position of the boom change-over valve has exceeded a predetermined position in a course of displacement towards the tank position.

2. The boom driving device according to claim 1, further comprising a working passage connecting the working chamber and the boom change-over valve, wherein the regenerative control valve is configured to displace between an ON-position that opens the regenerative passage and closes the working passage and an OFF-position that closes the regenerative passage and opens the working passage while increasing a connecting cross-sectional area to the regenerative passage as a displacement position approaches the ON-position from the OFF-position, and the controller is further programmed to cause the regenerative control valve to start displacement from the OFF-position towards the ON-position after the displacement position of the boom change-over valve has exceeded the predetermined position in the course of displacement towards the tank position.

3. The boom driving device according to claim 2, wherein the regenerative control valve comprises a spool that displaces between the OFF-position and the ON-position, a pilot chamber exerting a pilot pressure on an end of the spool, and a spring that biases the spool in a direction opposite to the pilot pressure, the boom driving device further comprises an electro-magnetic valve that supplies the pilot pressure to the pilot chamber, and the controller is further programmed to control the regenerating control valve via the electro-magnetic valve.

4. The driving device according to claim 3, wherein the electro-magnetic valve comprises a proportional electromagnetic valve.

* * * * *